US005077864A

United States Patent [19]

Kawasaki

[11] Patent Number: 5,077,864

[45] Date of Patent: Jan. 7, 1992

[54] SWING DOOR HINGE

[76] Inventor: Junzaburo Kawasaki, 2-56-2 Nihonbashi Hamacho, Chuo-ku, Tokyo, Japan

[21] Appl. No.: 634,372

[22] Filed: Dec. 27, 1990

[51] Int. Cl.[5] ..... E05F 1/12

[52] U.S. Cl. ..... 16/278; 16/281; 16/235; 16/286; 16/284; 16/305; 16/291; 16/296

[58] Field of Search ..... 16/277, 280, 281, 278, 16/284, 286, 296, 298, 304, 305, 291, 293

[56] References Cited

U.S. PATENT DOCUMENTS

| | | | |
|---|---|---|---|
| 1,294,793 | 2/1919 | Gray | 16/281 |
| 3,295,589 | 1/1967 | Pfleger | 16/281 |

FOREIGN PATENT DOCUMENTS

| | | | |
|---|---|---|---|
| 205661 | 6/1966 | Sweden | 16/281 |
| 12728 | of 1900 | United Kingdom | 16/281 |
| 11167 | of 1902 | United Kingdom | 16/281 |
| 383483 | 11/1932 | United Kingdom | 16/281 |

*Primary Examiner*—Robert L. Spruill

*Attorney, Agent, or Firm*—Jordan and Hamburg

[57] ABSTRACT

A swing door hinge is provided comprising a first hinge member having a projection of approximately rectangular block shape and provided with at least two engaging recesses, the first hinge member being intended to be mounted to either a wall frame or a swing door, and a second hinge member having at least two engaging arms inserted into respective engaging of the first hinge member for pivotal movement and guide openings provided in the engaging arms. The second hinge member, which is also intended to be mounted to the wall frame or the swing door whichever does not carry the first hinge member, has pivot pins mounted in the guide openings and yieldingly urged by respective springs in the inward direction. Each pivot pin is inserted at its front end into a respective engaging recess of the first hinge member and pivotably mounted to a shaft which is installed in such a position of the projection that the distance thereof from the front end of the projection is smaller than the distance thereof from each side end of the projection.

1 Claim, 14 Drawing Sheets

SWING DOOR HINGE

BACKGROUND OF THE INVENTION

The present invention relates to a swing door (FIGS. 16–18) hinge for pivotal movement of a swing door.

A known hinge construction for a swing door comprises an upper pin means A and a lower pin means B which both are arranged so that the co-axis of their respective pins P, P extends at a small angle to the side of a door C. The upper pin means A has a pair of support elements D, D arranged in symmetry about the pin P and extends across the opening provided in a support plate E. The support plate E also has a recess F formed therein on both sides of the opening for accepting the two support elements D, D so that the door C can securely be sustained at a given position with the two support elements D, D resting in the recess F by means of a gravity.

Hence, such a conventional swing door hinge has to be placed at a precise location on the door and also, its upper and lower pin means need to be separately mounted to their respective positions, adjacent to the corresponding corners of a door opening, on a door jamb frame, whereby the installation of a swing door(s) will be troublesome and claim more time and labor to be done.

Also, it is quite difficult for the arrangement of any known swing door hinge to allow a door to return to the original closed position automatically once the door has widely been opened more than 90 degrees to the frontward or backward.

SUMMARY OF THE INVENTION

The present invention is thus oriented, in view of the foregoing disadvantages, towards an improved swing door hinge which can be installed with ease and automatically return to the original closed position when a door has been opened up to more than 90 degrees in either the frontward or backward direction.

The foregoing and other objects and the novel aspects of the present invention will completely be apparent from the following detailed description in conjunction with the accompanying drawings.

It should be understood that the drawings are provided for ease of description and will not limit the scope of the present invention.

THE DESCRIPTION OF THE DRAWINGS

FIG. 1 is a general view explaining the present invention; FIG. 2 is an enlarged view of the primary part of FIG. 1; FIG. 3 is a partially broken cross sectional view showing one embodiment of the present invention; FIG. 4 is a cross sectional view taken along the line A—A of FIG. 2; FIGS. 5 to 7 are explanatory views of a first hinge member; FIGS. 8 to 10 are explanatory views of a second hinge member; FIGS. 11 and 12 are explanatory views showing the hinge action; FIGS. 13, 14, and 15 are explanatory views illustrating other embodiments of the present invention respectively; and FIGS. 16 to 18 are views explaining a prior art swing door hinge.

DESCRIPTION OF THE PREFERRED EMBODIMENTS

Figure 1:
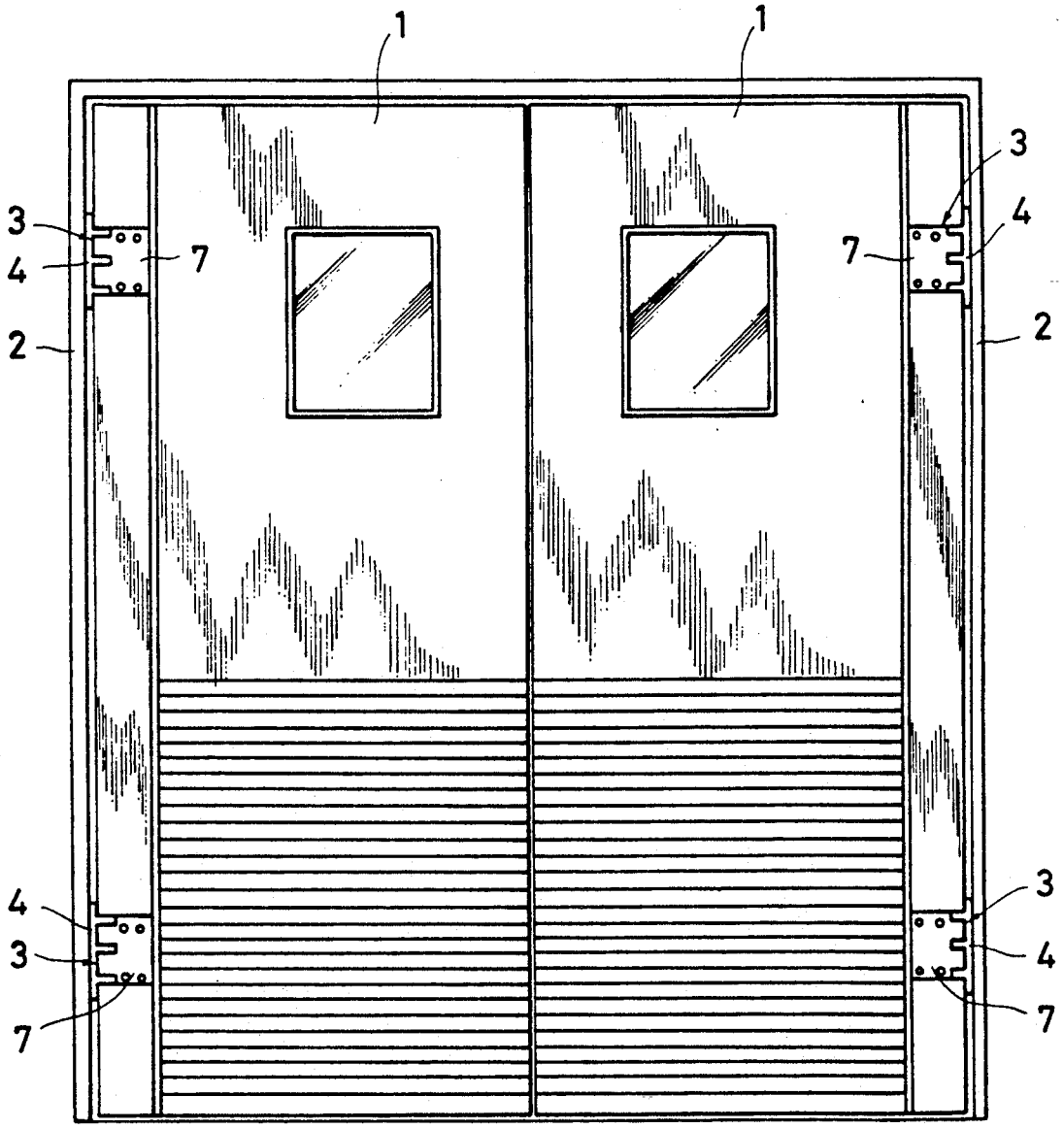
Figure 2:
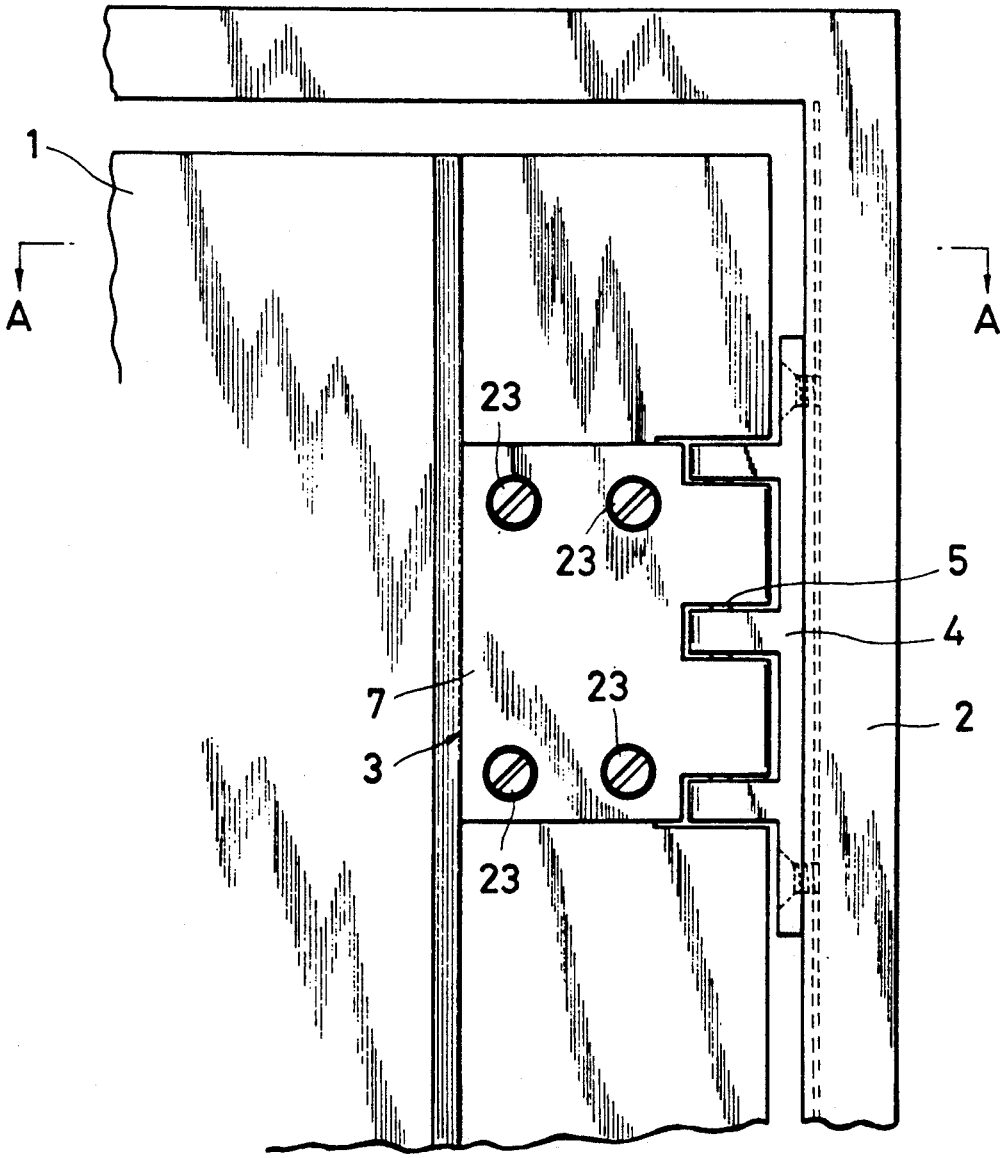

Preferred embodiments of the present invention will be described in more detail with reference to the accompanying drawings.

FIGS. 1 to 12 illustrate a primary embodiment of the present invention. As shown, a pair of swing doors 1, 1 provided in the opening of a building structure for opening and closing movements are pivotably mounted by a plurality of hinges-namely, two pairs of upper and lower hinges 3, 3, 3, 3 in this embodiment-to two wall frames 2, 2 respectively which are in turn fixed at both sides of the opening.

Each swing door hinge 3 comprises a first hinge member 4 of synthetic resin material mounted to the wall frame 2, a shaft 5 fixedly mounted to the first hinge member 4 so that the distance Y (FIG. 11) from the front end of the hinge member 4 to the axis of the shaft 5 is smaller than the distance X between each side end of the first hinge member 4 and the axis of the shaft 5, a couple of pivot pins 6, 6 mounted on the shaft 5 for pivotal movement, a second hinge member 7 of synthetic resin material mounted to the swing door 1 for coupling to the first hinge member 4 by the two pivot pins 6,6 inserted therein, and a couple of springs 8, 8 interposed between the second hinge member 7 and their respective pivot pins 6, 6 for yieldingly urging the second hinge member 7 towards the first hinge member 4.

Figure 5:
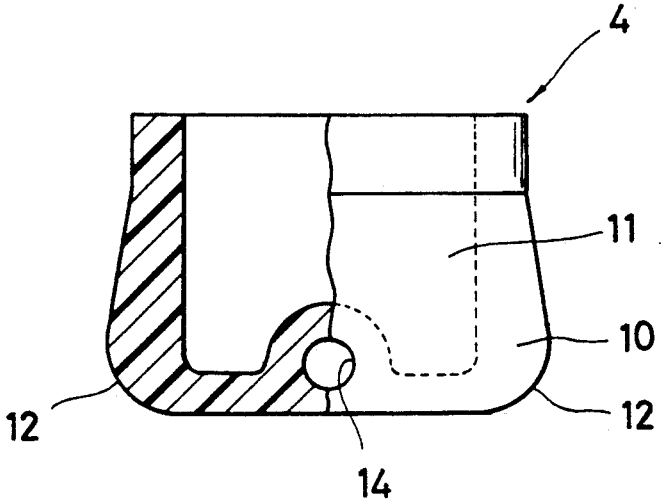
Figure 6:
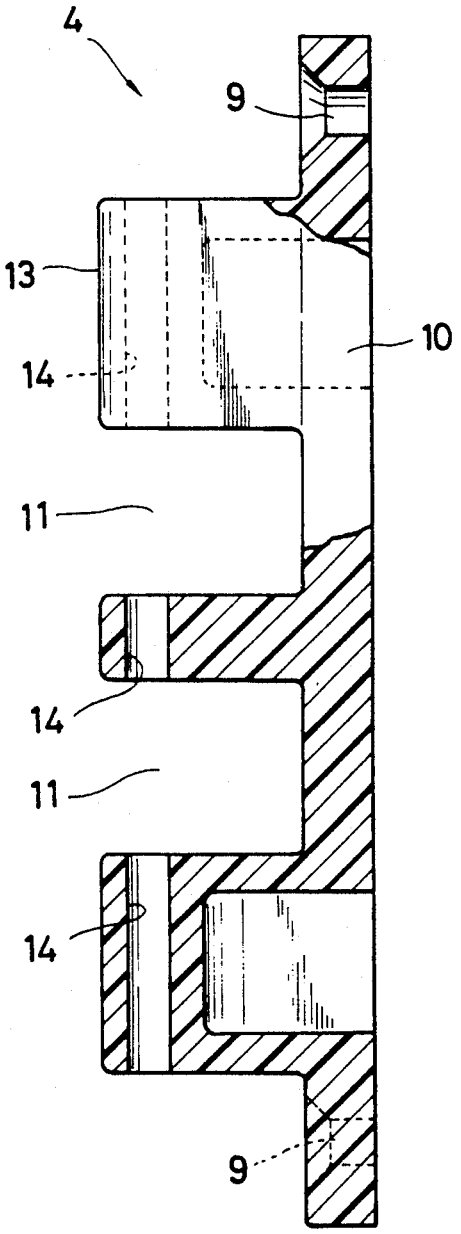
Figure 7:
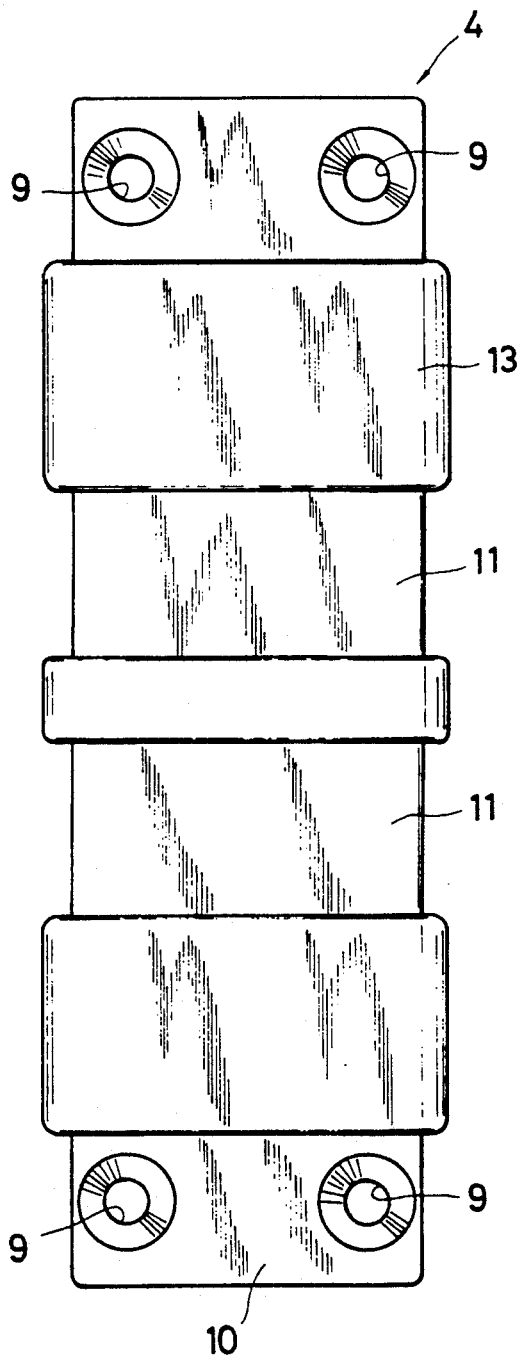

As best shown in FIGS. 5 to 7, the first hinge member 4 consists mainly of a first hinge body 10 provided at corners with insertion holes 9, 9, 9, 9 for accepting e.g. screws, a projection 13 extending from the surface of the first hinge body 10 and having a front side thereof arranged flat and both side corner portions 12, 12 thereof enlarged outwardly, a couple of engaging recesses 11, 11 arranged adjacent the projection 13, and a fitting bore 14 provided in a center region of the projection 13, where the distance Y is smaller than the distance X, for allowing the shaft 5 to extend therein across the engaging recesses 11, 11.

Figure 3:
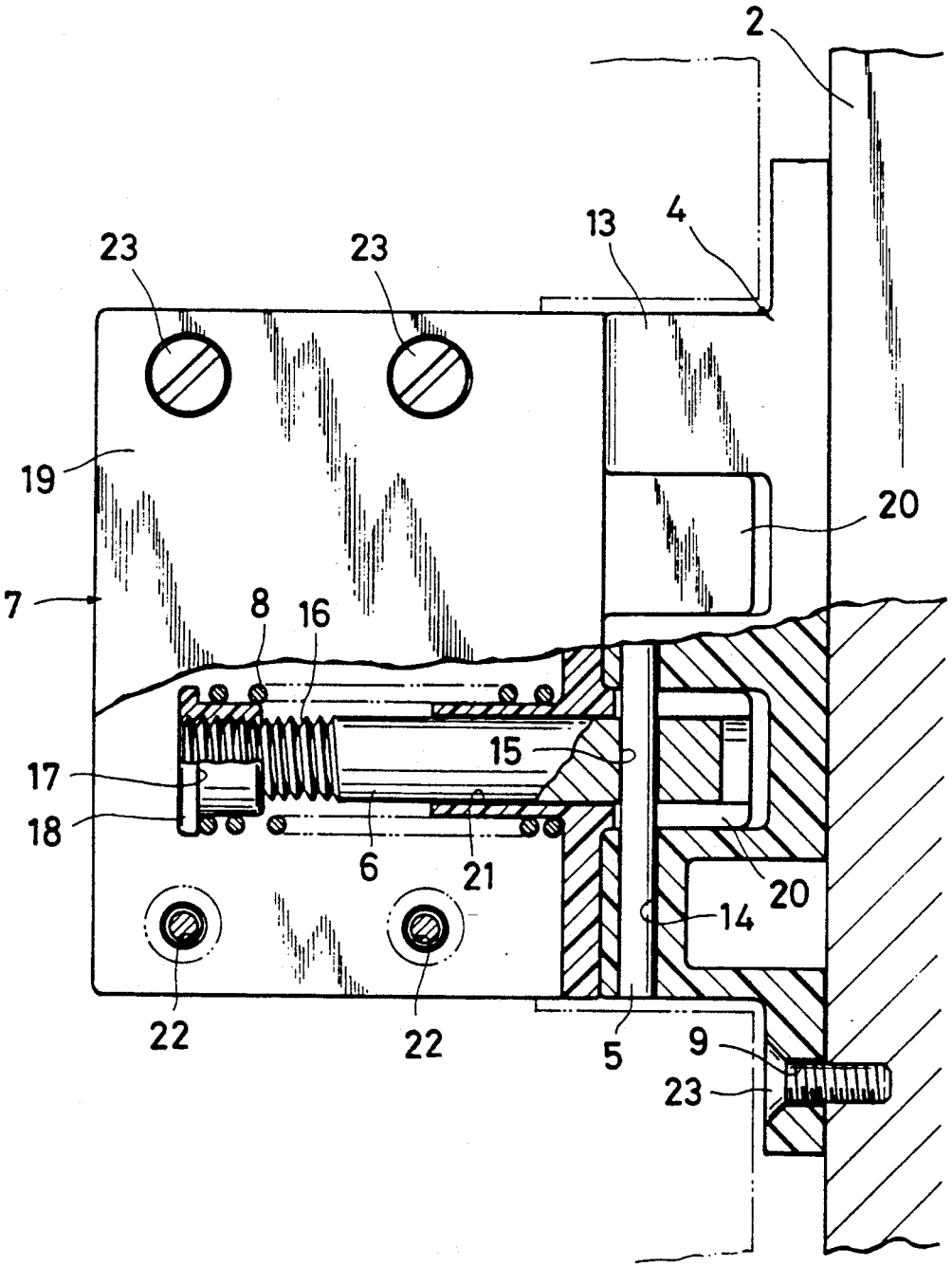
Figure 4:
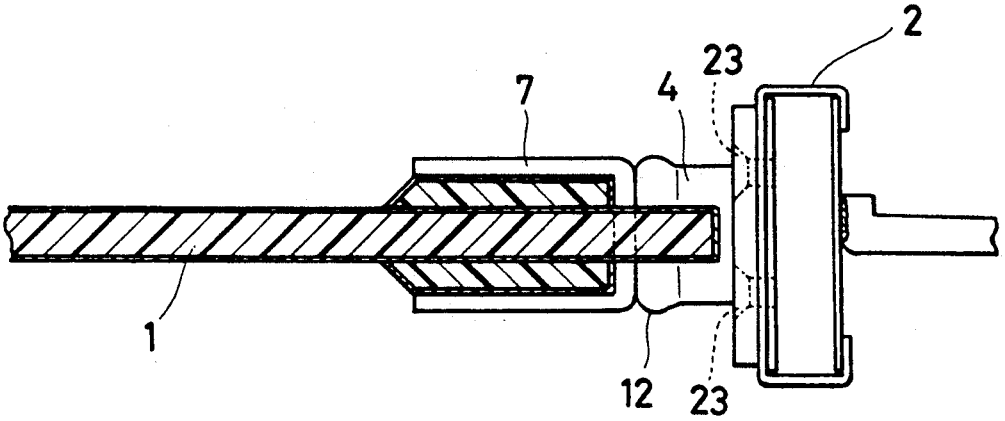

The pivot pin 6 is formed of a metal material, as shown in FIG. 3, having a through hole 15 provided in one end thereof, through which the shaft 5 can extend, and a thread 16 arranged in the other end.

The thread 16 of the pivot pin 6 is screwed in a retainer nut 18 provided with a spring stopper 17 for supporting one end of the spring 8.

Figure 8:
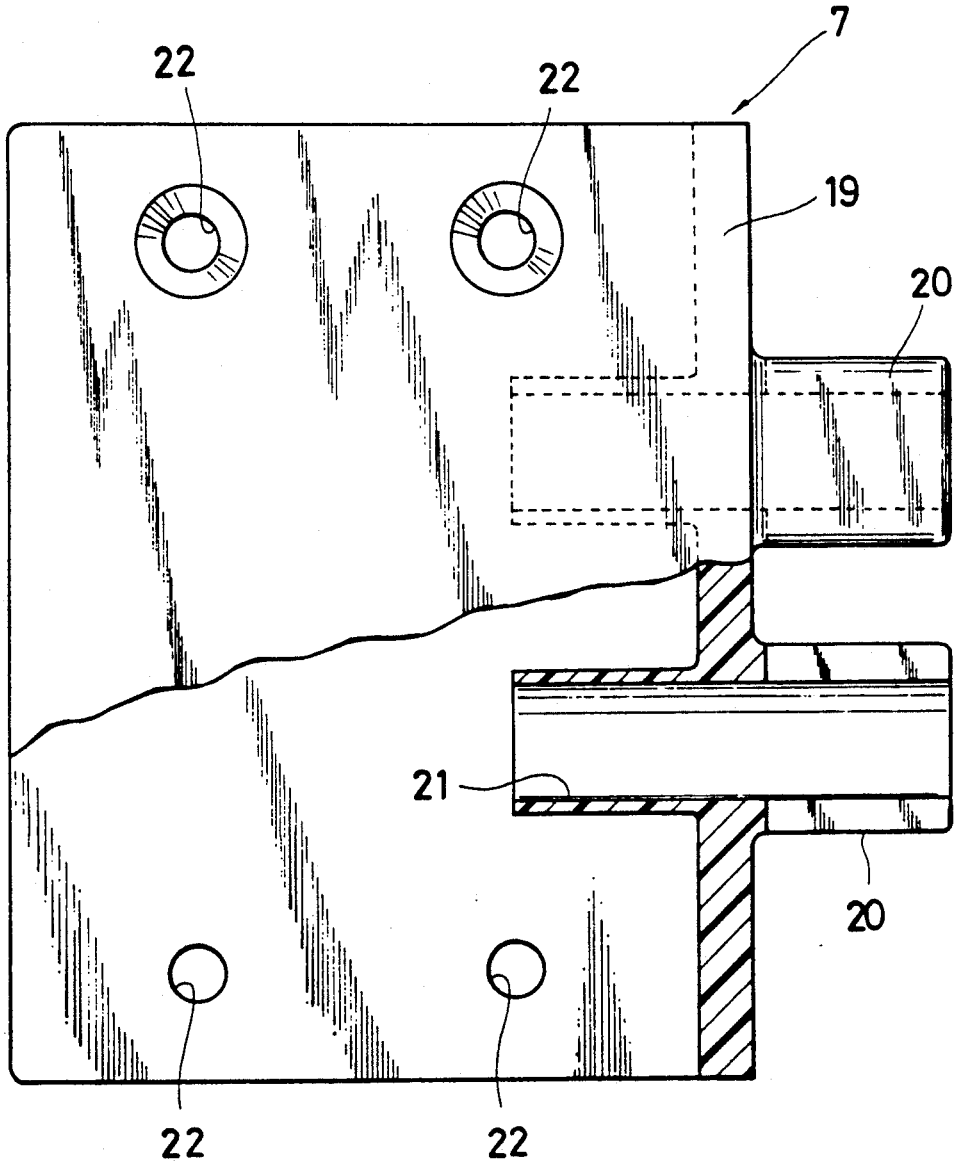
Figure 9:
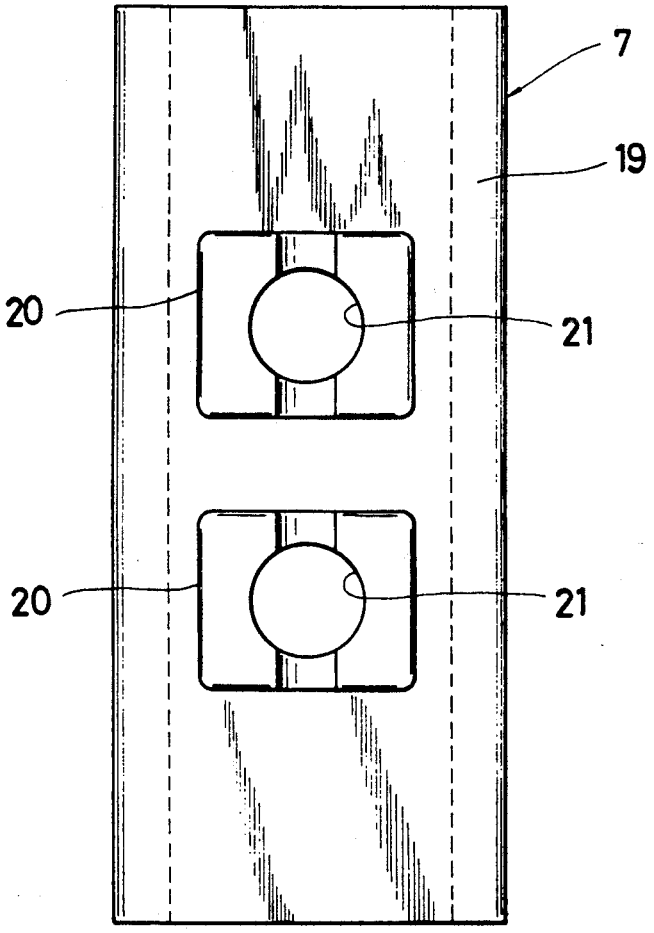
Figure 10:
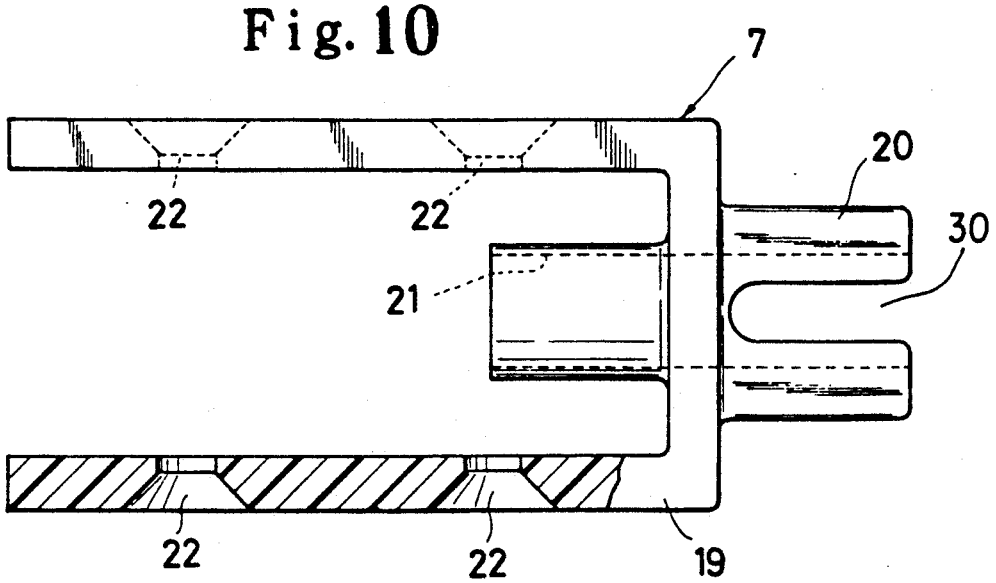

As shown in FIGS. 8 to 10, the second hinge member 7 consists mainly of a second hinge body 19 arranged in a channel shape for holding the swing door 1 and coming into surface contact with the flat side of the projection 13 of the first hinge member 4, a couple of engaging arms 20, 20 formed on the back of and integrally with the second hinge body 19 for engagement with the respective engaging recesses 11, 11 of the first hinge member 4, a couple of guide openings 21, 21 provided therein for accepting the pivoting pins 6, 6, and insertion holes 22, 22, 22, 22 arranged in the sides of the second hinge body 19 for fastening with e g. screws. A slot 30 is formed through each engaging arm 20 (FIG. 10). The shaft 5 is received in the slot 30, which permits movement of the second hinge member 7 radially with respect to the shaft 5.

For coupling, the pivot pins 6, 6 are inserted at one end into the recesses 11, 11 and secured with the shaft 5 which extends through the fitting bore 14 of the projection 13 and the through holes 15, 15 of the respective pivoting pins 6, 6. The shaft 5 is secured at both ends for preventing removal of the shaft 5 from the fitting bore 14.

Then, the pivot pins 6, 6 are inserted at the other end into the guide openings 21, 21 of the second hinge member 7 and the springs 8, 8 are fitted onto the pivot pins 6, 6 which both extend inwardly of the second hinge member 7. The nuts 18, 18 are screwed onto the threads 16, 16 of their respective pivot pins 6, 6 and locked when the springs 8, 8 yield a given tension.

The nuts 18, 18 may be locked by double nut fastening or tightened with the use of set bolts.

Each swing door hinge 3 assembled in the foregoing manner is now fixed for installation of the swing doors 1, 1 in the building opening by fastening with appropriate screws 23 the first hinge member 4 to the wall frame 2 and the second hinge member 7 to the swing door 1.

Figure 11:
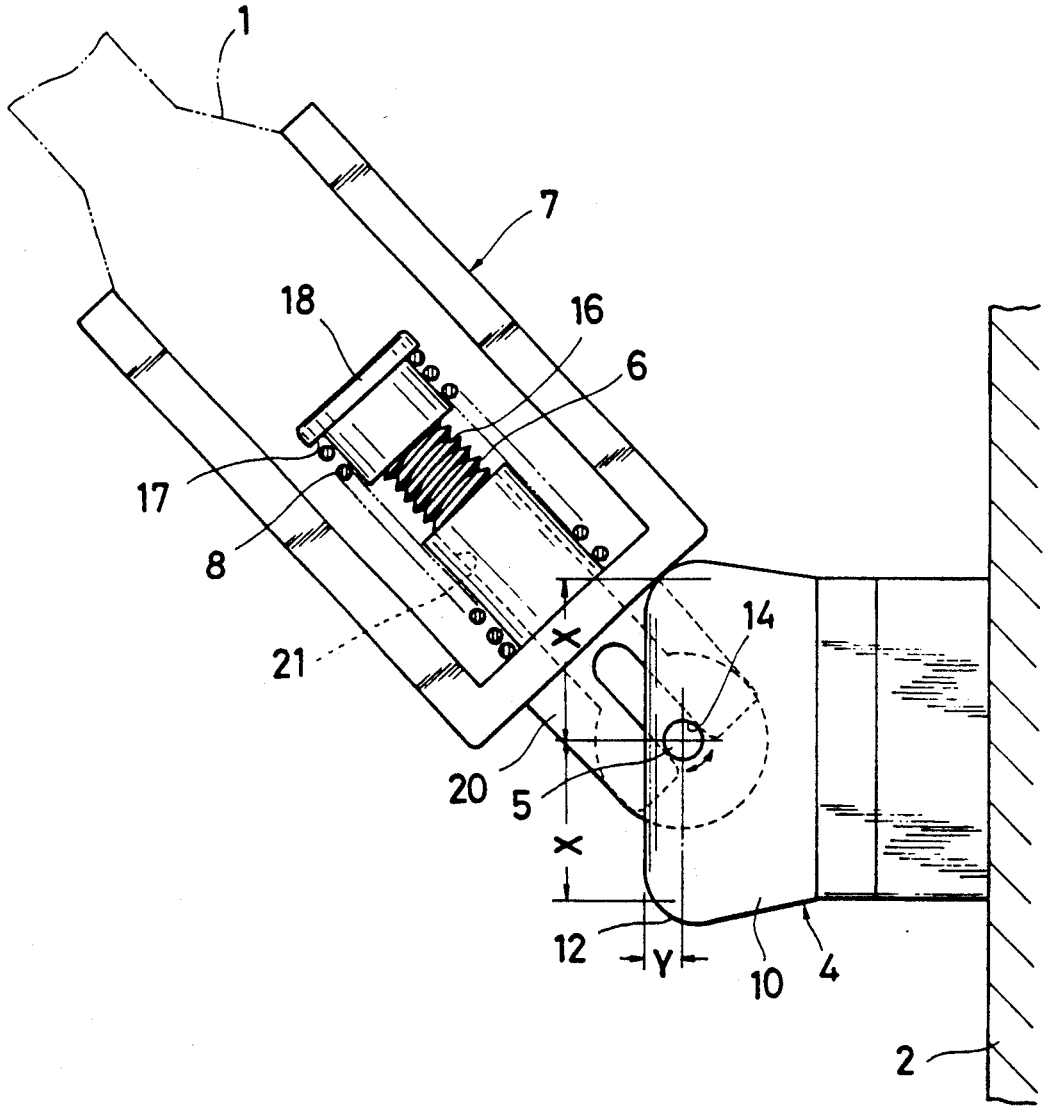

In operation, the tension of the springs 8, 8 is increased in proportion to the opening angle of the swing door 1 when the opening and closing movement either to the frontward or to the rearward is through 90 degrees, as shown in FIG. 11. Hence, when the swing door 1 is released at any angle, it will be returned by the yielding force of the springs 8, 8 back to the original position where the first and second hinge members 4 and 7 come in contact with each other at the flat interface.

In other words, the swing doors 1, 1 are returned to the closing position.

Figure 12:
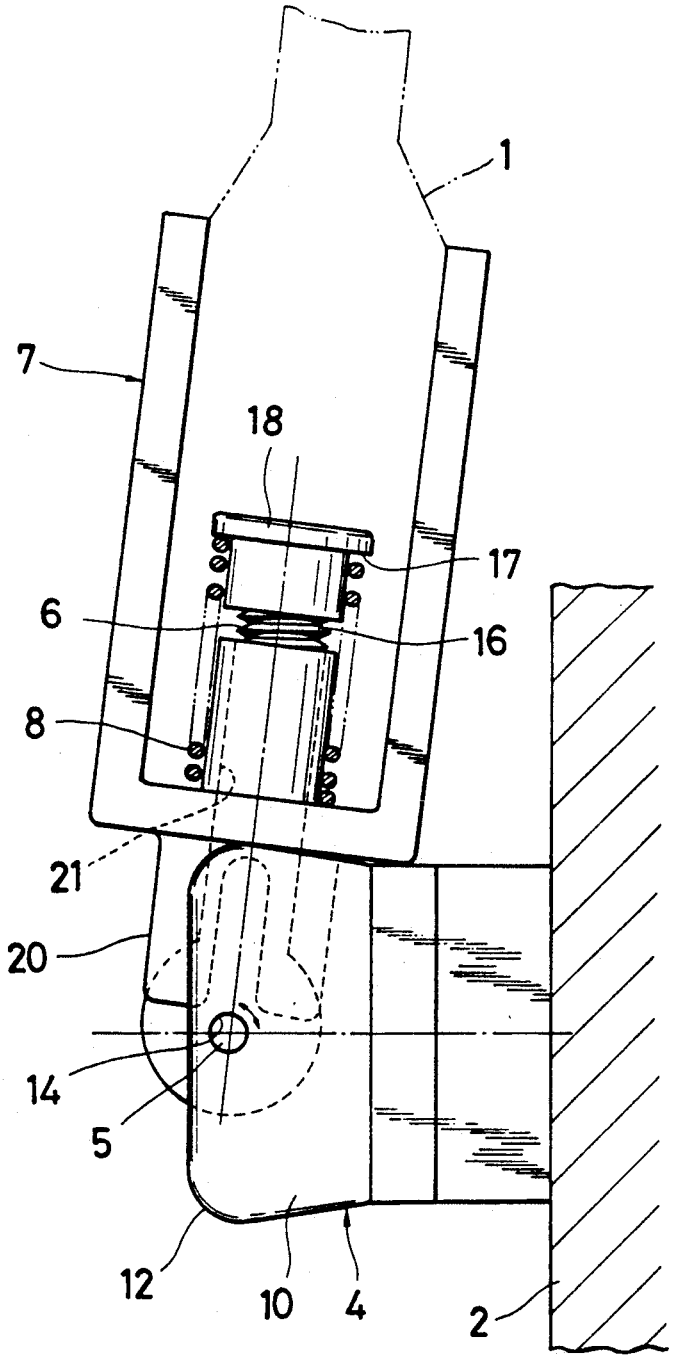

When the swing door 1 is turned to more than 90 degrees in either the frontward or rearward direction, the yielding force of the springs 8, 8 then intends to urge the swing door 1 towards the opening direction and will hold the same in the open state (as shown in FIG. 12).

Other embodiments of the present invention will now be described referring to FIGS. 13 to 15, in which like components are represented by like numerals as illustrated in the previous embodiment and not explained again.

Figure 13:
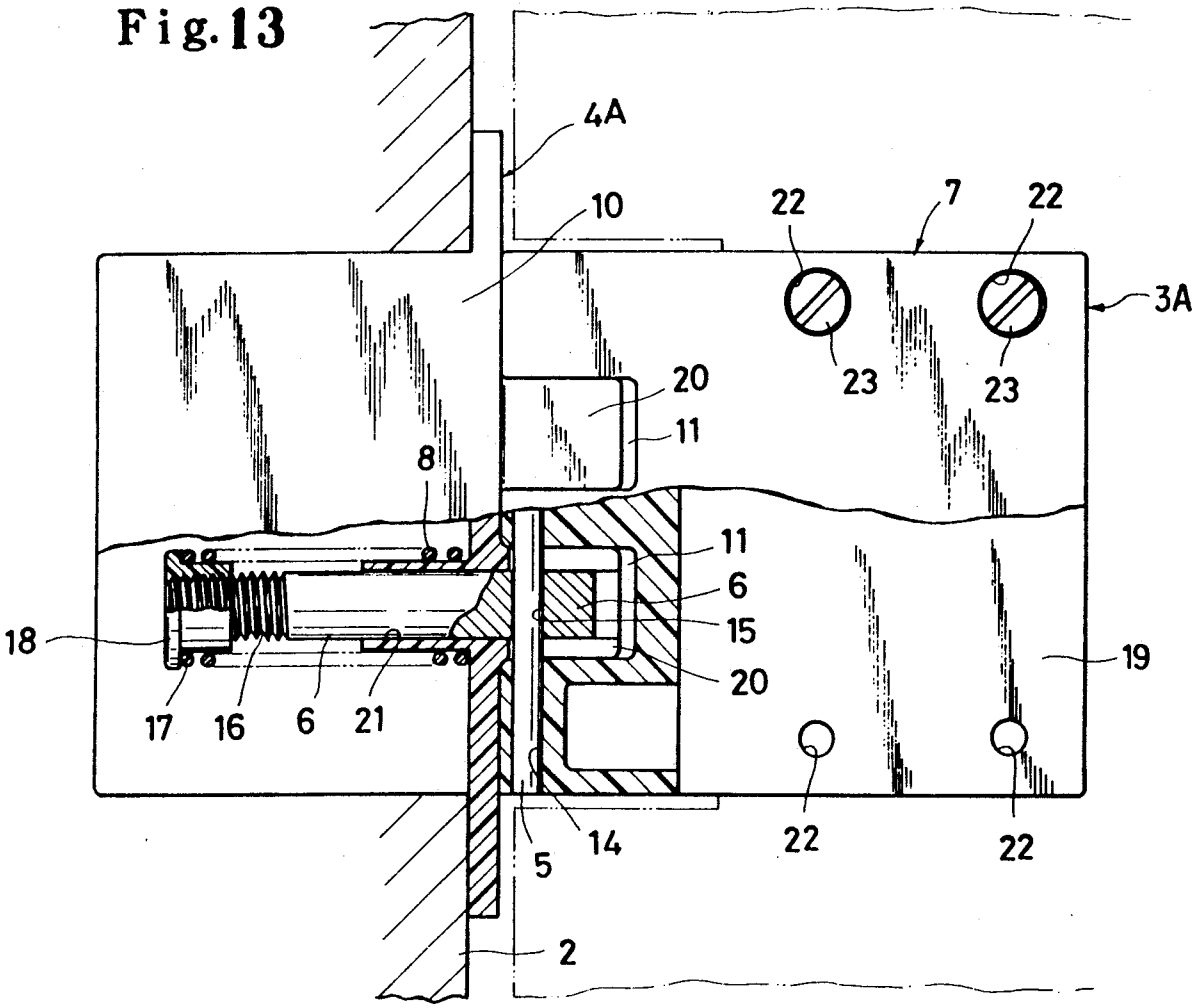

A first alternative embodiment is portrayed in FIG. 13, in which the difference from the previous embodiment resides in the pivot pins 6, 6 being urgingly mounted in a first hinge member 4A. Accordingly, a swing door hinge 3A of this embodiment will act equivalent to the previous embodiment.

Figure 14:
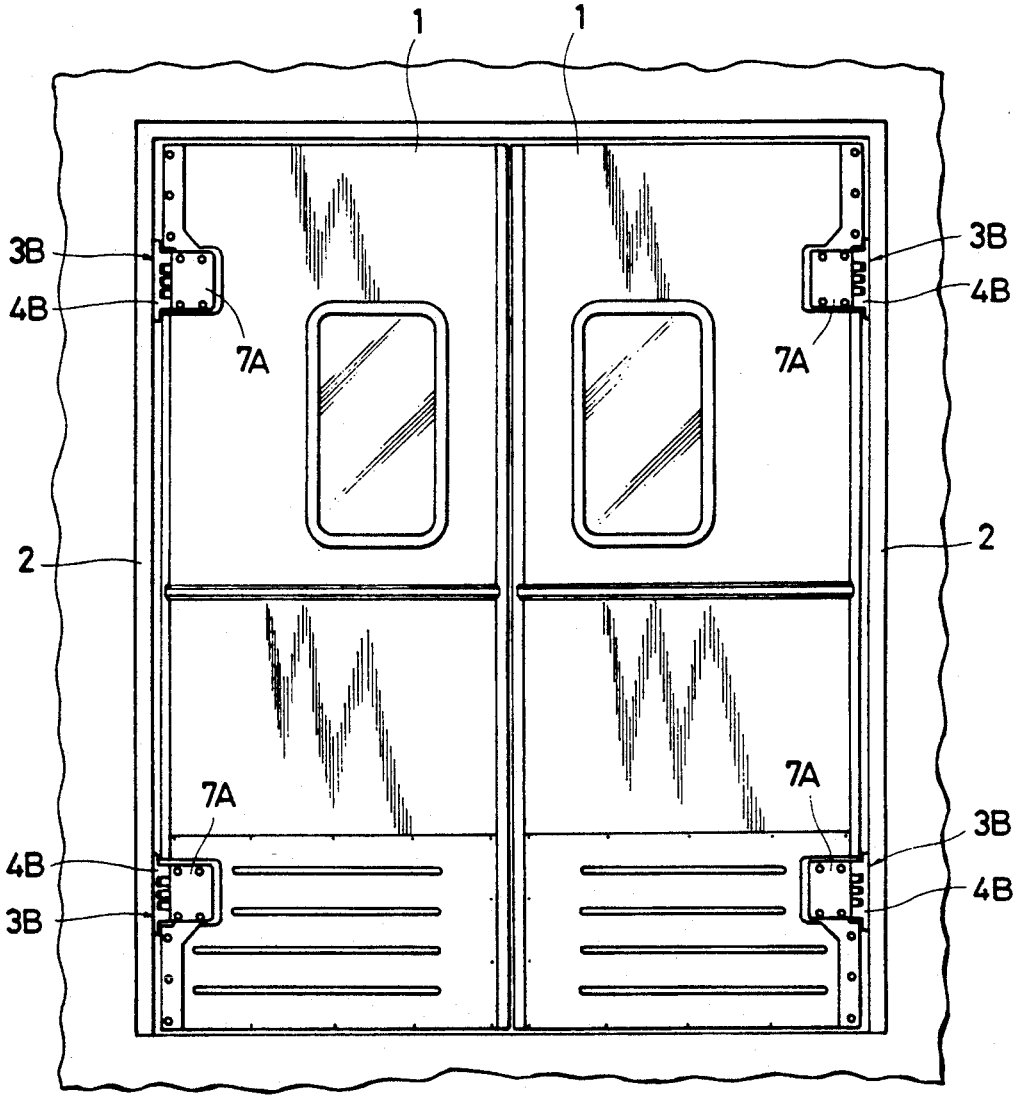
Figure 15:
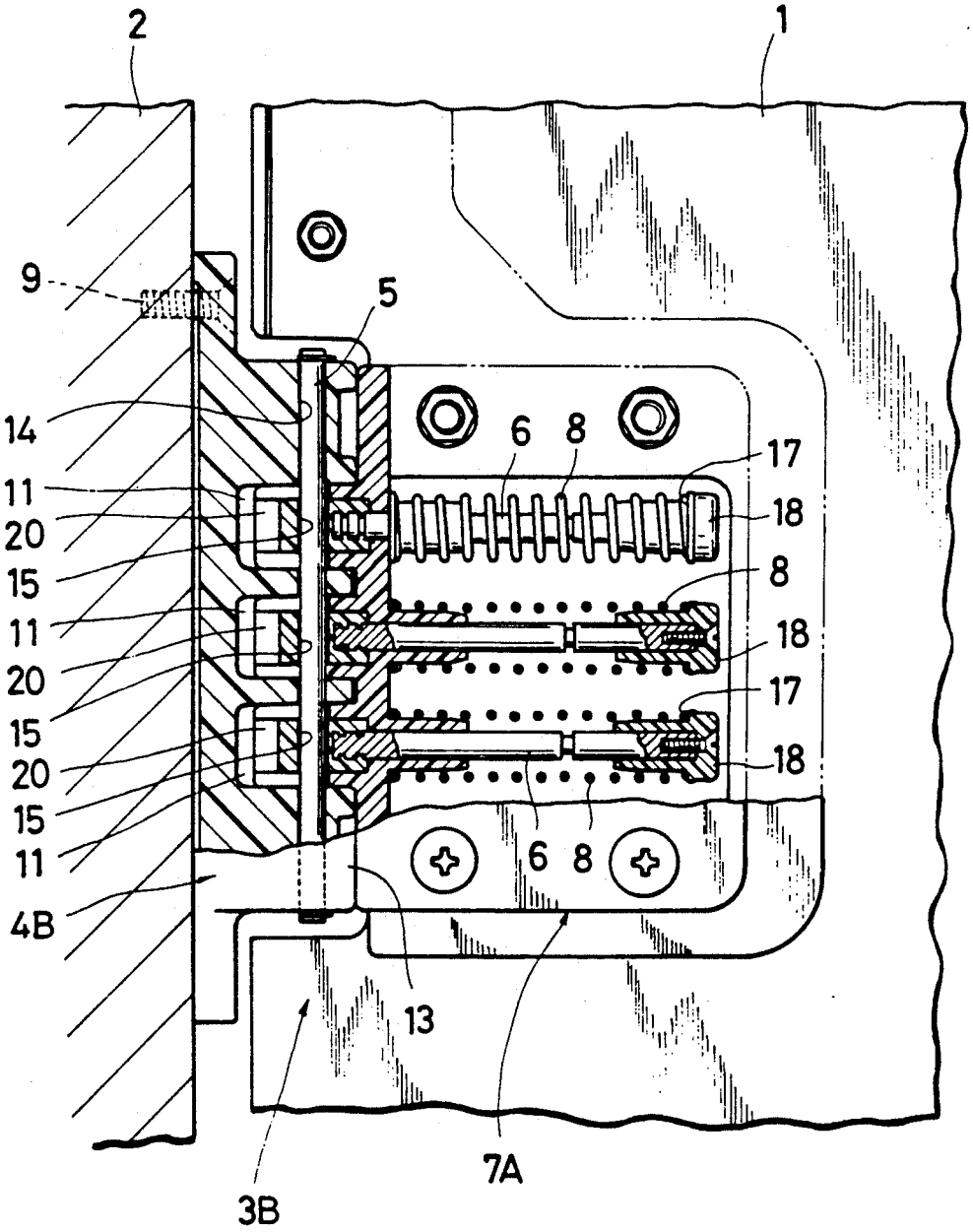
Figure 16:
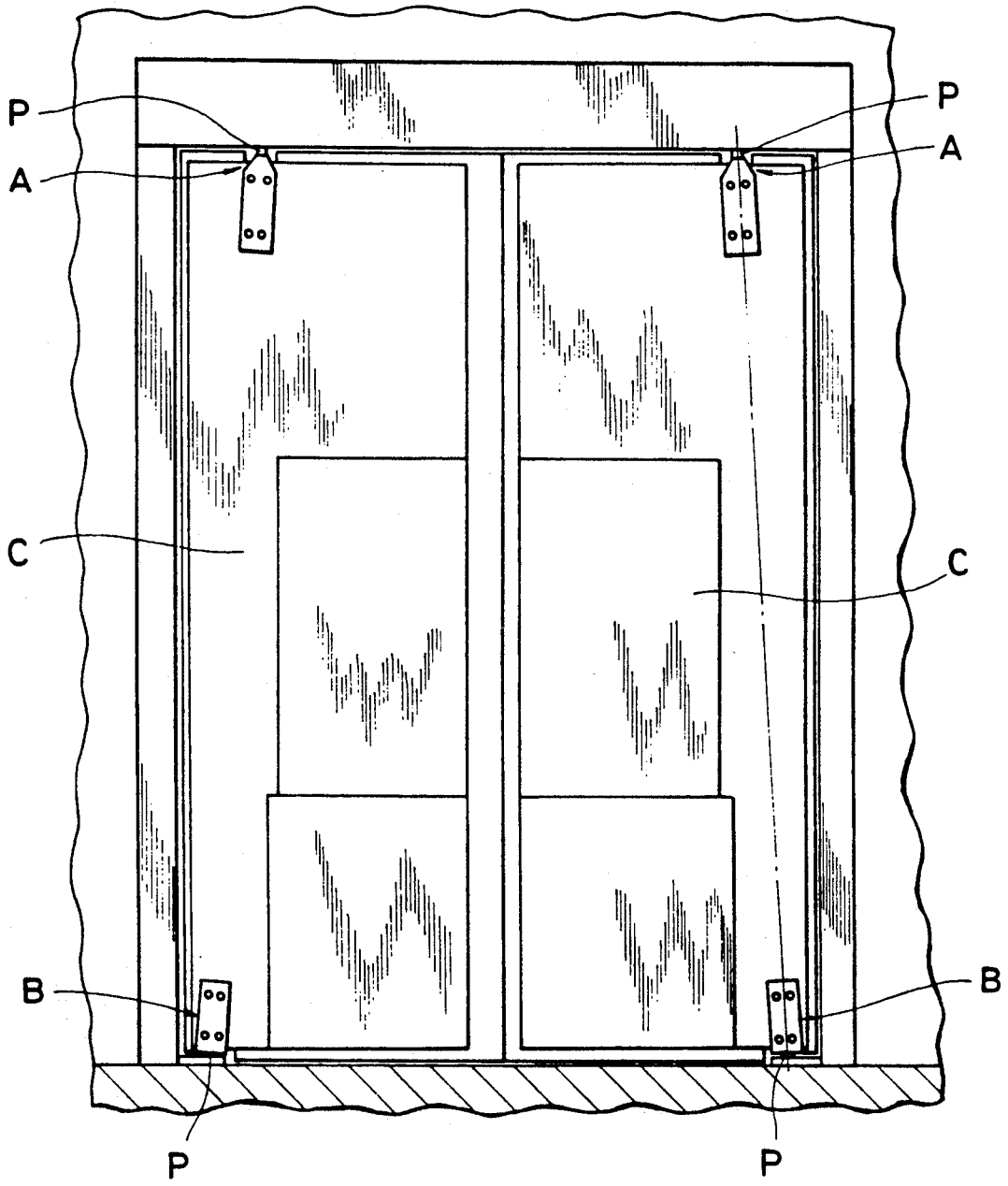
Fig. 16 PRIOR ART
Figure 17:
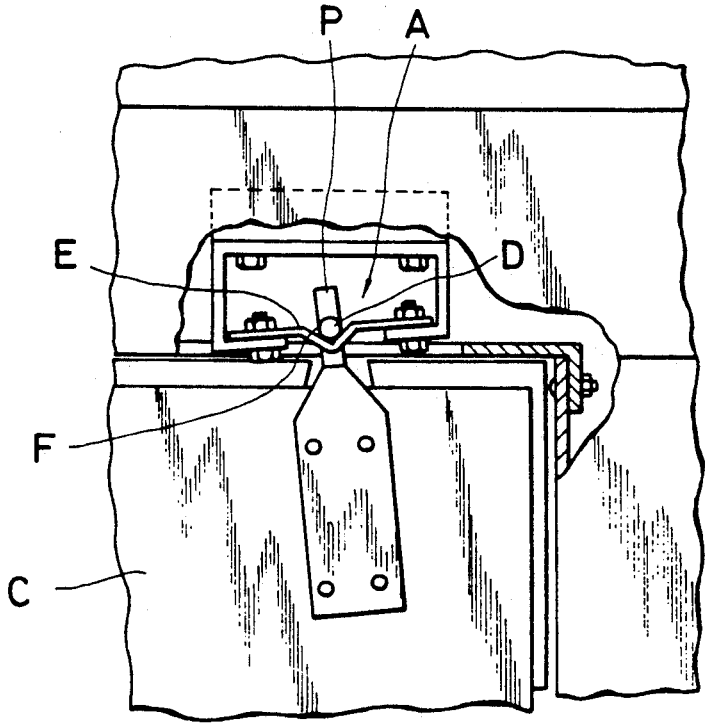
Fig. 17 PRIOR ART
Figure 18:
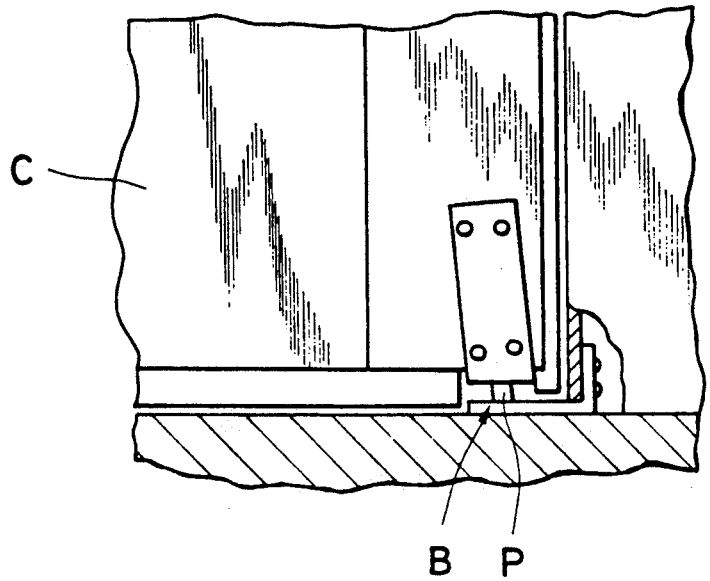
Fig. 18 PRIOR ART

Also, a further embodiment shown in FIGS. 14 and 15 is differentiated from the previous embodiments by providing in combination a first hinge member 4B including projection 13 having three engaging recesses 11, 11, 11 arranged therein, a second hinge member 7A provided with three engaging arms 20, 20, 20 which are in turn inserted into the corresponding engaging recesses 11, 11, 11 of the first hinge member 4B, and three of the pivot pins 6, 6, 6, all of which constitutes a swing door hinge 3B. Like the previous embodiment, this arrangement of the swing door hinge 3B will be used with equal success.

Although the first and second hinge members 4 and 7 are formed of a synthetic resin material throughout the embodiments, they may be fabricated by any other appreciable material.

As apparent from the above description, the present invention will provide the following advantages.

(1) The shaft, on which the pivot pins urgingly installed between the first and second hinge members are pivotably mounted, is located at such a position in the rectangular projection of the first hinge member that its distance from the front end of the projection is smaller than its distance from the side ends of the projection, whereby the swing door can be turned more than 90° in swing action to both the frontward and the rearward.

More specifically, the swing action of the swing door will be almost doubled in distance of movement.

(2) The pivot pins are provided for sliding along the guide openings in the second hinge member so that the second hinge member can move axially of the pivot pins and perform a pivotal action when the swing door is turned in swing motion. Accordingly, the first and second hinge members will be protected and free from unwanted dirt or obstacles.

(3) The first and second hinge members are fixedly secured to the wall frame and the swing door respectively with screws or the like, whereby the installation of the doors will be carried out with ease by the same procedure as of conventional hinges.

(4) The yielding force of the springs is controlled by adjusting the location of the spring stopper of the nut screwed onto each pivot pin and thus, will arbitrarily be determined.

(5) The first and second hinge members are formed of synthetic resin material and will thus be fabricated with lower cost in industrial production.

(6) The first and second hinge members are substantially composed of pivot pins, a shaft, and springs, and thus, are of a minimum number of necessary components, forming a simple arrangement.

What is claimed is:

1. A swing door hinge comprising:

a first hinge member having a projection of approximately rectangular block shape provided with engaging recesses, which is intended to be mounted onto either a wall frame or a swing door, the first hinge member having a rear end for being received on a mounting surface of a wall frame or swing door, opposite thereto a front end defined by a surface of the projection most remote from the rear end of the first hinge member, and a pair of side ends;

a second hinge member including a second hinge body of channel shape, the channel shape being constituted of a pair of mutually parallel side walls connected by an end wall, the end wall having an inner face facing into a channel defined by said face and respective inner faces of the side walls and having an outer face arranged to come into surface contact with the front end surface of the projection of the first hinge member, pairs of engaging arms extended from the outer face of the end wall, each pair forming an approximately U-shaped form and being received in a respective one of the engaging recesses of the first hinge member for pivotal movement, and guide openings provided in the engaging arms to extend across the second hinge body, said second hinge member being intended to be mounted to the wall frame or the swing door whichever does not carry the first hinge member;

pivot pins each slidably mounted in a respective one of the guide openings of the second hinge member;

a shaft installed in such a position of the rectangular projection of the first hinge member that the distance thereof from the front end of the projection is smaller than the distance thereof from each of the side ends of the projection and on which the pivot pins are pivotably mounted, the second hinge member being provided with passage means through which the shaft passes and which is so configured as to permit displacement of the second hinge member radially with respect to the shaft;

and springs each provided within the second hinge member for urging a respective one of the pivot pins away from the rear end of the first hinge member, each of the side ends of the projection of the first hinge member having a surface which together with the front end surface of the projection includes an angle of less than 90°, whereby the door can be opened more than 90° in either of its swing directions from a closed position of the door whereupon the springs hold the door in an open position with the outer face of the end wall of the channel of the second hinge member being pressed against one of the side ends of the first hinge member by action of the springs and the door automatically swings to its closed position by action of the springs when the door is manually moved from being opened more than 90° to being opened less than 90° and then released.

* * * * *